US005834408A

United States Patent [19]

Mishra et al.

[11] Patent Number: 5,834,408

[45] Date of Patent: Nov. 10, 1998

[54] POUR POINT DEPRESSANTS VIA ANIONIC POLYMERIZATION OF (METH)ACRYLIC MONOMERS

[75] Inventors: Munmaya K. Mishra, Richmond; Raymond G. Saxton, Hanover, both of Va.

[73] Assignee: Ethyl Corporation, Richmond, Va.

[21] Appl. No.: 957,046

[22] Filed: Oct. 24, 1997

[51] Int. Cl.[6] ..... C10M 145/14; C08F 220/18

[52] U.S. Cl. ..... 508/469; 526/329.5; 526/329.7

[58] Field of Search ..... 508/469; 526/329.5, 526/329.7

[56] References Cited

U.S. PATENT DOCUMENTS

| | | | |
|---|---|---|---|
| 3,252,949 | 5/1966 | Fields et al. | 508/469 |
| 3,304,260 | 2/1967 | Fields et al. | 508/469 |
| 4,146,492 | 3/1979 | Cusano et al. . | |
| 4,606,834 | 8/1986 | Hart et al. . | |
| 4,867,894 | 9/1989 | Pennewiss et al. | 252/56 R |
| 5,112,509 | 5/1992 | Brink, Jr. et al. | 508/469 |
| 5,188,770 | 2/1993 | Pennewiss | 508/469 |
| 5,312,884 | 5/1994 | Gore | 526/328 |
| 5,368,761 | 11/1994 | Gore et al. | 508/469 |
| 5,534,175 | 7/1996 | Cantiani . | |
| 5,552,491 | 9/1996 | Mishra et al. . | |
| 5,726,136 | 3/1998 | Koch | 508/469 |

FOREIGN PATENT DOCUMENTS

| | | |
|---|---|---|
| 153209 | 8/1985 | European Pat. Off. . |
| 603956 | 6/1994 | European Pat. Off. . |
| 96/23008 | 8/1996 | WIPO . |

*Primary Examiner*—Jacqueline V. Howard
*Attorney, Agent, or Firm*—Dennis H. Rainear; Thomas Hamilton

[57] ABSTRACT

The present invention relates to the product(s) of the polymerization of specific combinations of acrylic monomers, and optionally vinyl and/or performance enhancing comonomers, in the presence of an anionic initiator to form copolymers having a narrow molecular weight distribution. Additionally, the invention relates to the use of these copolymers as pour point depressants in lubricating oil formulations.

17 Claims, No Drawings

POUR POINT DEPRESSANTS VIA ANIONIC POLYMERIZATION OF (METH)ACRYLIC MONOMERS

FIELD OF THE INVENTION

The present invention relates to the polymerization of acrylic monomers, and optionally vinyl comonomers, in the presence of an anionic initiator to form copolymers having a narrow molecular weight distribution. Additionally, the invention relates to the use of these copolymers as pour point depressants in lubricating oil formulations.

BACKGROUND OF THE INVENTION

The polymerization of acrylic or methacrylic monomers, such as, for example, alkyl acrylates and methacrylates as well as the copolymerization of acrylic and methacrylic monomers with vinyl comonomers in the presence of anionic polymerization initiators is generally known. Initiators having the general formula:

R—M in which M denotes an alkali metal or an alkaline earth metal and R denotes a straight-chain or branched alkyl containing 2 to 6 carbon atoms or an aryl have been employed. Examples of such initiators include n-butyllithium, sec-butyllithium, naphthalenesodium, 1,4-disodio-1,1,4,4-tetraphenyl butane, diphenylmethyl potassium, diphenylmethyl sodium, 1'-methylstyryllithium, 1,1-diphenyl-3-methylpentyllithium and others such as tertiary alcoholates of lithium and compounds containing trimethylsilyl groups.

It is advantageous for various applications of acrylate or methacrylate polymers or copolymers that there be a narrow range of molecular weight distribution of the polymers of copolymers. In some cases, polymers have been prepared having a wide range of molecular weight distribution and this polymer composition is physically treated to form a material in which the polymer molecular weights fall within some narrower range. Additionally, it has been found that various additives including non-nitrogenous complexing agents can be added to the anionic polymerization reaction mixture so as to obtain polymers having relatively low polydispersity (see, for example, U.S. Pat. Nos. 4,927,703 and 4,826,941).

In general, there are numerous publications and patents in the general area of acrylates and methacrylates prepared by anionic polymerization. U.S. Pat. No. 4,927,703, U.S. Pat. No. 4,826,941 and Fayt et al., *Macromolecules* Vol. 20, 1442–1444 (1987) are illustrative. These citations disclose the use of lithium chloride and crown ethers to prepare narrow polydispersity poly (meth) acrylates. For example, at page 1442 of Fayt et al., it is noted that by the use of lithium chloride one can prepare polymethacrylates with a polydispersity of 1.2–1.6 as compared to 3.61 without lithium chloride.

U. S. Pat. No. 5,534,175 discloses viscosity improvers for lubricating oils comprising copolymers of unsaturated fatty esters. The patent teaches that the copolymers have a polydispersity value, Mw/Mn, of between about 2 and 5.

WO 96/23008 teaches the anionic polymerization process used in the present invention. WO 96/23008 does not teach the specific combinations of (meth) acrylic monomers required by the present invention or the use of polymers obtained via anionic polymerization as pour point depressants.

It is an object of the present invention to provide novel copolymers obtained via an anionic copolymerization process. The copolymers of the present invention are copolymers of acrylates and/or methacrylates having a narrow molecular weight distribution. Preferably, the copolymers are used as pour point depressants for oils of lubricating viscosity.

SUMMARY OF THE INVENTION

The present invention relates to novel copolymers useful as pour point depressants for oils of lubricating viscosity obtained by the anionic copolymerization of specific combinations of (meth) acrylic monomers. The anionic polymerization process used in forming the pour point depressants of the present invention is taught in WO 96/23008 (U.S. Ser. No. 08/378,978, filed Jan. 27, 1995, incorporated herein by reference). In the process for the anionic polymerization or copolymerization of acrylates and methacrylates, the monomers or comonomers are added to the anionic polymerization reaction medium either at once or in a rapid continuous manner (not drop-by-drop).

DETAILED DESCRIPTION OF THE INVENTION

The novel copolymers of the present invention are copolymers comprising:

a) 0 to 60 weight % of at least one acrylic monomer of the formula:

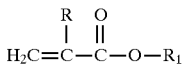

wherein R is hydrogen or methyl, and $R_1$ is an alkyl group having from 1 to 5 carbon atoms;

b) 0 to 60 weight % of at least one acrylic monomer of the formula:

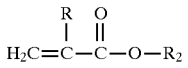

wherein R is hydrogen or methyl, and $R_2$ is an alkyl group having from 6 to 14 carbon atoms; and c) 15 to 80 weight % of at least one acrylic monomer of the formula:

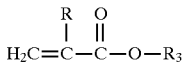

wherein R is hydrogen or methyl, and $R_3$ is an alkyl group having from 15 to 22 carbon atoms; with the proviso that at least one of comonomers a) and b) be present and the total amount of monomers a)+b) is from 20 to 85 weight percent of the resulting copolymer.

Suitable (meth) acrylate monomers for comonomer a) include methyl acrylate, methyl methacrylate, ethyl acrylate, ethyl methacrylate, propyl acrylate propyl methacrylate, isopropyl methacrylate, n-butyl acrylate, n-butyl methacrylate, isobutyl acrylate, isobutyl methacrylate, tert-butyl acrylate, tert-butyl methacrylate. Preferred comonomers for component a) are methyl methacrylate and butyl methacrylate and mixtures thereof.

Suitable (meth) acrylate monomers for comonomer b) include 2-ethylhexyl acrylate, 2-ethylhexyl methacrylate, hexyl acrylate, hexyl methacrylate, lauryl acrylate, lauryl methacrylate and mixtures thereof. The preferred comonomer b) is lauryl methacrylate.

Suitable (meth) acrylate monomers for comonomer c) include stearyl acrylate, stearyl methacrylate, pentadecyl acrylate, pentadecyl methacrylate, hexadecyl acrylate, and hexadecyl methacrylate and mixtures thereof. The preferred comonomer c) is stearyl methacrylate.

The comonomers a) to c) when prepared commercially commonly are mixtures of lower and higher fatty derivatives obtained by use of a crude alcohol mixture during esterification. The carbon number of the monomer is that of the ester which is the predominant ester in the monomer. For example, for purposes of the present invention, lauryl methacrylate is considered to be a comonomer b) wherein R is methyl and $R_2$ is an alkyl group having 12 carbon atoms, although as commercially available, lauryl methacrylate is a mixture containing also lower and higher fatty derivatives. Further, for purposes of this invention, stearyl methacrylate is considered to be a comonomer c) wherein R is methyl and $R_3$ is an alkyl group having 18 carbon atoms, although as commercially available, stearyl methacrylate is a mixture containing also lower and higher fatty derivatives.

Non-acrylic vinyl comonomers may optionally be included in the copolymers of the present invention. Suitable vinyl comonomers include, but are not limited to, butadiene, isoprene, styrene, alpha-methyl styrene, vinyl toluene, t-butyl styrene, chlorostyrene, vinylnaphthalene, 2-vinylpyridine, 4-vinylpyridine, and the like.

Further, monomers that provide further improvements to the performance of the copolymer properties such as dispersancy, antioxidancy and antiwear may also be included in the copolymers of the present invention. Typical performance enhancing monomers of this class include N,N-dimethylamino propyl methacrylamide, N,N-diethylamino propyl methacrylamide, N,N-dimethylaminoethyl acrylamide, N,N-diethylaminoethyl acrylamide, N,N-dimethylaminoethyl methacrylate, N,N-diethylaminoethyl acrylate, N,N-dimethylaminoethyl thiomethacrylate, poly(ethylene glycol) ethyl ether methacrylate, poly(ethylene glycol) 4-nonylphenyl ether acrylate and poly(ethylene glycol) phenyl ether acrylate.

Initiators useful in the present invention include initiators of the formula:

R—M in which M is an alkali metal or an alkaline earth metal and R is a straight-chain or branched alkyl or cyclo-alkyl preferably having from 1 to 6 carbon atoms or an aryl. Examples of such initiators include, for example, hydrocarbyl lithium initiators such as alkyllithium compounds, preferably methyl lithium, n-butyllithium, sec-butyllithium, cycloalkyllithium compounds, preferably, cyclohexyllithium and aryllithium compounds, preferably, phenyllithium, 1-methylstyryllithium, p-tolyllithium, naphyllithium and 1,1-diphenyl-3-methylpentyllithium. Also useful initiators include, naphthalene sodium, 1,4-disodio- 1,1,4,4-tetraphenylbutane, diphenylmethyl potassium, and diphenylmethyl sodium. Tertiary alcoholates of lithium and compounds containing trimethylsilyl groups may also be employed.

The process for preparing the copolymers of the present invention is preferably carried out in the absence of moisture and oxygen and in the presence of at least one inert solvent. Preferably, the polymerization is conducted in the absence of any impurity that is detrimental to an anionic catalyst system. The inert solvent is preferably a hydrocarbon, such as isobutane, pentane, cyclohexane, benzene, toluene, xylene, tetrahydrofuran, diglyme, tetraglyme, orthoterphenyl, biphenyl, decalin or tetralin.

The copolymerization temperature useful in producing the copolymers of the present invention varies between about 30° C. and about −78° C, preferably between about 0° C. and −50° C.

The present process employs 1,1 -diphenylethylene in the initiator system for the anionic polymerization. 1,1-diphenylethylene has relatively high electro-affinity and does not homopolymerize.

The present process enables the preparation of a wide range of copolymers including block copolymers wherein the number average molecular weight is between about 500 to about 1,000,000, preferably from about 5000 to about 300,000, and having a polydispersity index, Mw/Mn, (ratio of the value of the weight-average molecular mass to the value of the number-average molecular mass) of about 1.0 to about 2.0, preferably from about 1.0 to about 1.5.

In the process for producing the novel copolymers of the present invention, the polymerization is generally carried out in an inert atmosphere, for example under nitrogen, argon, etc. atmosphere. Equipment used in the polymerization reaction should be carefully dried such as by drying at about 150° C. for several hours. Solvents and reagents are also carefully dried. As an example, if tetrahydrofuran (THF) is used as the polymerization medium, the THF can be freshly distilled over sodium-benzophenone or anhydrous THF can be used. Acrylic, methacrylic or other monomers or comonomers can be purified by passing the monomer or comonomer through alumina. Diphenyl ethylene (DPE) can be dried over molecular sieve. The metallic initiators are normally used as received.

It is preferred, for purposes of achieving the desired polydispersity for the copolymers produced in the above described process, that the comonomers be added to the polymerization reactor in a particular manner. The monomers are added to the reactor containing reaction medium and initiator together or sequentially depending upon whether random or block copolymers are desired. The comonomers are preferably added in one-shot (at once) as a single amount or rapidly added as a continuous stream. It is preferred that dropwise addition not be used. The reaction can take place in a batch reactor, a continuous tubular reactor or any other suitable reactor wherein the polymerization reaction medium and the comonomers are contacted at once or in a rapid continuous manner. The reaction is quite fast and is normally complete within a few seconds. Conversion is also quite good in the instant process and is generally approximately 100% conversion.

The copolymers of the present invention find their primary utility as pour point depressants in lubricating oil compositions which employ a base oil in which the additives are dissolved or dispersed. Such base oils may be natural or synthetic. Base oils suitable for use in preparing the lubricating oil compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the copolymers of the present invention as pour point depressants in base oils conventionally employed in and/or adapted for use as power transmitting fluids, heavy duty hydraulic fluids, power steering fluids and the like. Gear lubricants, industrial oils, pump oils and other lubricating oil compositions can also benefit from the incorporation therein of the copolymers of the present invention.

These lubricating oil formulations conventionally contain additional additives that will supply the characteristics that are required in the formulations. Among these types of additives are included viscosity index improvers, antioxidants, corrosion inhibitors, detergents, dispersants, anti-wear agents, anti-foamants, demulsifiers and friction modifiers.

The copolymers of the present invention may be employed as they are as pour point depressants for lubricating oils, the quantity of the copolymers used corresponding to a proportion of about 0.01 to 1 percent by weight, preferably 0.05 to 0.3 percent by weight, of the mass of the lubricating oil to be treated.

It is convenient, however, to use the copolymers in the form of an additive concentrate comprising the copolymers of this invention and any additional additives with a normally liquid organic diluent, such as natural oils, mineral oils or mixtures thereof, or other suitable solvent. The additive concentrate, in accordance with the present invention, normally comprises from about 25 to about 75% by weight of at least one copolymer, and optionally additional additives, in accordance with the invention, the remainder to 100% consisting essentially of a normally liquid organic diluent. The purpose of concentrates, of course, is to make the handling of the various materials less difficult and awkward as well as to facilitate solution or dispersion in the final blend.

The copolymers of the present invention will be generally used in admixture with a lube oil basestock, comprising an oil of lubricating viscosity, including natural and synthetic lubricating oils and mixtures thereof.

Natural oils include animal oils and vegetable oils (e.g., castor, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

THE FOLLOWING EXAMPLES ARE PROVIDED AS BEING ILLUSTRATIVE AND ARE NOT INTENDED TO BE IN ANY WAY LIMITING ON THE SCOPE OF THE PRESENT INVENTION.

EXPERIMENTAL PROCEDURE

In the following examples, polymerizations were carried out in a reactor under nitrogen atmosphere. Polymerizations were carried out by contacting the comonomers and initiator system in a reactor in a continuous manner. The initiator system contained diphenylethylene and sec-butyllithium in anhydrous THF. The prepared polymer was recovered and the molecular weight and distributions were determined by Gel Permeation Chromatograph using polystyrene and/or polymethylmethacrylate calibration.

Table 1 demonstrates the affect of various copolymers on the pour points of lubricating oils. Copolymers containing methyl methacrylate (MMA), butyl methacrylate (BMA), lauryl methacrylate (LMA) and/or stearyl methacrylate (SMA), as indicated in the Table below, were added to a 5W30 base oil in various amounts. The pour points of these oils, at various copolymer concentrations, was measured according to ASTM D 97 and are set forth in Table 1.

TABLE 1

| Ex. # | Monomers (ratio) | ~Mn (× 1000) | PP (°C.) 0.08 wt % | PP (°C.) 0.14 wt % | PP (°C.) 0.20 wt % | PP (°C.) 0.40 wt % |
|---|---|---|---|---|---|---|
| 1 | SMA:LMA (25:75) | 21 | | | −36 | −36 |
| 2 | SMA:LMA (45:55) | 33 | | | −33 | −33 |
| 3 | SMA:LMA (50:50) | 12.5 | −33 | −33 | −33 | |
| 4 | SMA:LMA (50:50) | 25 | −33 | −33 | −33 | |
| 5 | SMA:LMA (50:50) | 50 | −25 | −31 | | |
| 6 | SMA:LMA (50:50) | 75 | −27 | −33 | −33 | |
| 7 | SMA:LMA (75:25) | 25 | −21 | −21 | −24 | |
| 8 | SMA:BMA (50:50) | 25 | −30 | −30 | −30 | |
| 9 | SMA:BMA (50:50) | 50 | −28 | −33 | | |
| 10 | SMA:LMA:MMA (30:50:20) | 22 | | | −30 | −36 |
| 11 | SMA:LMA:MMA (30:50:20) | 35.5 | | | −27 | −33 |
| 12 | SMA:LMA:MMA (33:33:33) | 26 | | | −30 | −24 |
| 13 | SMA:LMA:BMA (33:33:33) | 25 | −36 | −36 | | |
| 14 | SMA:LMA:BMA (33:33:33) | 50 | −24 | −39 | | |
| 15 | SMA:LMA:BMA (33:33:33) | 75 | −33 | −36 | −33 | |
| 16 | SMA:LMA:BMA (35:13:52) | 25 | −33 | −33 | −33 | |
| 17 | SMA:LMA:BMA (35:13:52) | 50 | −30 | −33 | | |
| 18 | SMA:LMA:BMA (35:13:52) | 75 | −33 | −36 | −33 | |
| 19 | SMA:LMA:BMA (35:52:13) | 12.5 | −33 | −30 | −36 | |
| 20 | SMA:LMA:BMA (35:52:13) | 25 | −30 | −33 | −36 | |
| 21 | SMA:LMA:BMA (35:52:13) | 50 | −30 | −30 | −30 | |
| 22 | SMA:LMA:BMA (35:52:13) | 75 | −30 | −33 | −33 | |
| 23 | SMA:LMA:MMA (40:40:20) | 21.5 | | | −36 | −36 |
| 24 | SMA:LMA:MMA (40:40:20) | 93 | | | −30 | −33 |
| 25 | SMA:LMA:MMA (40:50:10) | | | | −36 | −36 |
| 26 | SMA:LMA:BMA (40:40:20) | 26 | | | −36 | −39 |
| 27 | SMA:LMA:BMA (40:40:20) | 66.5 | | | −30 | −36 |
| 28 | SMA:LMA:MMA (50:40:10) | 24 | | | −33 | −36 |
| 29 | SMA:LMA:BMA (50:40:10) | 24.5 | | | −33 | −33 |
| 30 | SMA:LMA:MMA (60:30:10) | 10 | | | −33 | −33 |
| 31 | SMA:LMA:BMA (60:30:10) | 25 | | | −30 | −30 |
| C.1 | Base oil | | | | | −15 |
| C.2 | LMA:MMA (75:25) | 27.5 | | | −18 | −15 |

The conversions in all of the examples were about 100% and the initiating efficiencies were close to about 100%. The polymers produced have a fairly narrow polydispersity in the range of about 1.2–1.4.

It is clear from the above Table, that lubricating oils containing copolymers within the scope of the instant claims exhibit superior pour points compared to base oil alone (Example C.1) and to lubricating oils containing copolymers outside the scope of the claims (C.2).

This invention is susceptible to considerable variation in practice. Accordingly, this invention is not limited to the specific exemplifications set forth hereinabove. Rather, this invention is within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part of the invention under the doctrine of equivalents.

We claim:

1. A copolymer prepared by the anionic polymerization of a mixture comprising a) 0 to 60 weight % of acrylic monomer(s) of the formula:

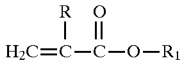

wherein R is hydrogen or methyl, and $R_1$ is an alkyl group having from 1 to 5 carbon atoms;

b) 0 to 60 weight % of acrylic monomer(s) of the formula:

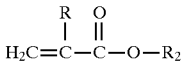

wherein R is hydrogen or methyl, and $R_2$ is an alkyl group having from 6 to 14 carbon atoms; and c) 15 to 80 weight % of acrylic monomer(s) of the formula:

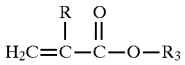

wherein R is hydrogen or methyl, and $R_3$ is an alkyl group having from 15 to 22 carbon atoms; with the proviso that at least one of comonomers a) and b) are present and the total amount of monomers a)+b) is from 20 to 85 weight percent, wherein the copolymer has a polydispersity index of from about 1 to about 1.5.

2. The copolymer of claim 1 wherein monomer a) is selected from the group consisting of methyl methacrylate, butyl methacrylate and mixtures thereof.

3. The copolymer of claim 1 wherein monomer b) is lauryl methacrylate.

4. The copolymer of claim 1 wherein the monomer c) is stearyl methacrylate.

5. The copolymer of claim 1 further comprising at least one monomer selected from the group consisting of non-acrylic vinyl monomers and performance enhancing monomers.

6. The copolymer of claim 1 wherein the anionic polymerization is carried out in a polymerization initiator medium comprising an inert solvent, an initiator having the formula

R—M in which M is an alkali metal or an alkaline earth metal and R is a straight chain or branched alkyl or cyclo-alkyl or an aryl; and diphenylethylene.

7. The copolymer of claim 6 wherein the monomers are added to the polymerization initiator medium as a single, one-shot dosage.

8. The copolymer of claim 6 wherein the monomers are added to the polymerization medium in a continuous manner.

9. A concentrate, for addition to a lubricating oil, comprising from about 25 to about 75% by weight of the copolymer of claim 1 and from about 75 to about 25% by weight of a normally liquid organic diluent.

10. The concentrate of claim 9 wherein the normally liquid organic diluent is selected from the group consisting of natural oils, synthetic oils and mixtures thereof.

11. The concentrate of claim 9 further comprising at least one additive selected from the group consisting of viscosity index improvers, antioxidants, corrosion inhibitors, detergents, dispersants, anti-wear agents, anti-foamants, demulsifiers and friction modifiers.

12. A pour point depressant for use in lubricating oil formulations comprising the copolymer of claim 1.

13. A lubricating oil formulation comprising a major amount of an oil of lubricating viscosity and a minor amount of the copolymer of claim 1.

14. The lubricating oil of claim 13 wherein the copolymer is present in an amount of about 0.01 to 1 percent by weight of the mass of the lubricating oil to be treated.

15. The lubricating oil of claim 13 wherein the oil of lubricating viscosity is selected from the group consisting of natural oils, synthetic oils and mixtures thereof.

16. The lubricating oil of claim 13 further comprising at least one additive selected from the group consisting of viscosity index improvers, antioxidants, corrosion inhibitors, detergents, dispersants, anti-wear agents, anti-foamants, demulsifiers and friction modifiers.

17. A method of improving the pour point of a lubricating oil composition comprising adding to an oil of lubricating viscosity a minor amount of the copolymer of claim 1.

* * * * *